US008746680B2

(12) United States Patent
Lo

(10) Patent No.: US 8,746,680 B2
(45) Date of Patent: Jun. 10, 2014

(54) PAPER TRAY FOR PRINTER

(75) Inventor: Wen-Chung Lo, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/571,457

(22) Filed: Aug. 10, 2012

(65) Prior Publication Data

US 2014/0001700 A1 Jan. 2, 2014

(30) Foreign Application Priority Data

Jun. 28, 2012 (TW) ..... 101123239 A

(51) Int. Cl.
*B65H 3/52* (2006.01)

(52) U.S. Cl.
USPC ..... 271/121; 271/167

(58) Field of Classification Search
USPC ..... 271/121, 167
See application file for complete search history.

(56) References Cited

U.S. PATENT DOCUMENTS

| | | | | |
|---|---|---|---|---|
| 6,279,897 | B1 * | 8/2001 | Richards | 271/121 |
| 7,128,317 | B2 * | 10/2006 | Johnson et al. | 271/121 |
| 7,852,526 | B2 * | 12/2010 | Mo et al. | 358/498 |
| 2009/0026693 | A1 * | 1/2009 | Lim | 271/121 |

* cited by examiner

*Primary Examiner* — Michael McCullough
(74) *Attorney, Agent, or Firm* — Novak Druce Connolly Bove + Quigg LLP

(57) ABSTRACT

A paper tray for a printer includes a bottom plate and a rear plate. A plurality of papers is placed on the bottom plate. The plurality of papers includes a first paper and a second paper. The first paper is located on a topmost portion of the plurality of papers, and the second paper is located adjacent to the first paper and below the first paper. A plurality of bent pieces is secured on the rear plate. Each bent piece includes a first piece and a second piece. The first piece is placed on the rear plate. An obtuse angle is defined between the first piece and the second piece. The second pieces of the plurality of bents pieces are configured to allow the first paper sliding there over, and block the second paper sliding there over.

15 Claims, 4 Drawing Sheets

PAPER TRAY FOR PRINTER

BACKGROUND

1. Technical Field

The present disclosure relates to paper trays, and more particularly to a paper pray for a printer.

2. Description of Related Art

Printer usually includes a paper tray for placing papers therein. While the printer prints, a piece of paper is picked up from paper tray and sent into the printer. However, in some situation, two pieces of paper may be picked from the paper tray together and fed into the printer, which may cause the papers to be jammed in the printer.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
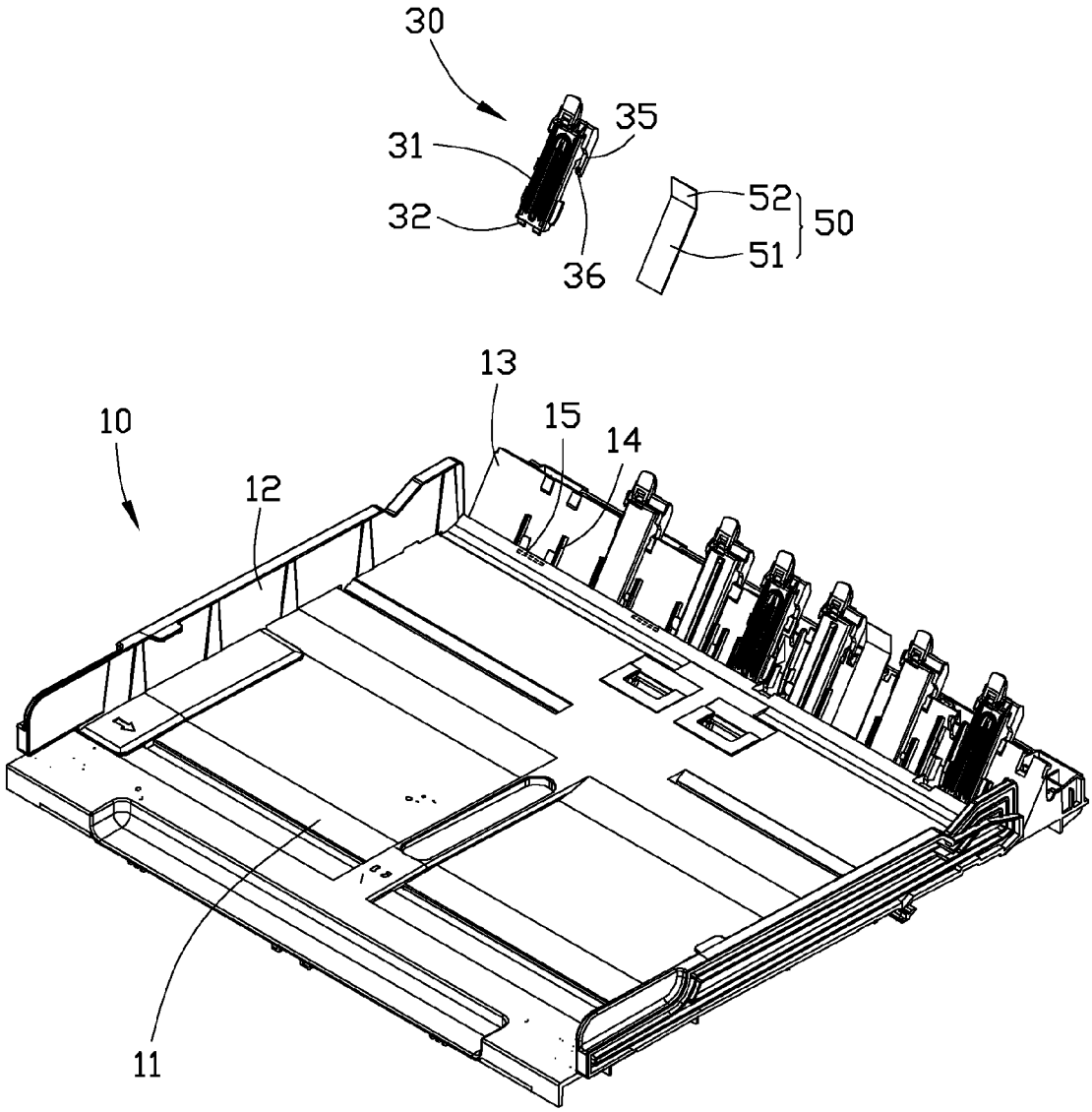
FIG. 1 is an exploded and isometric view of an embodiment of a paper tray for a printer.
Figure 2:
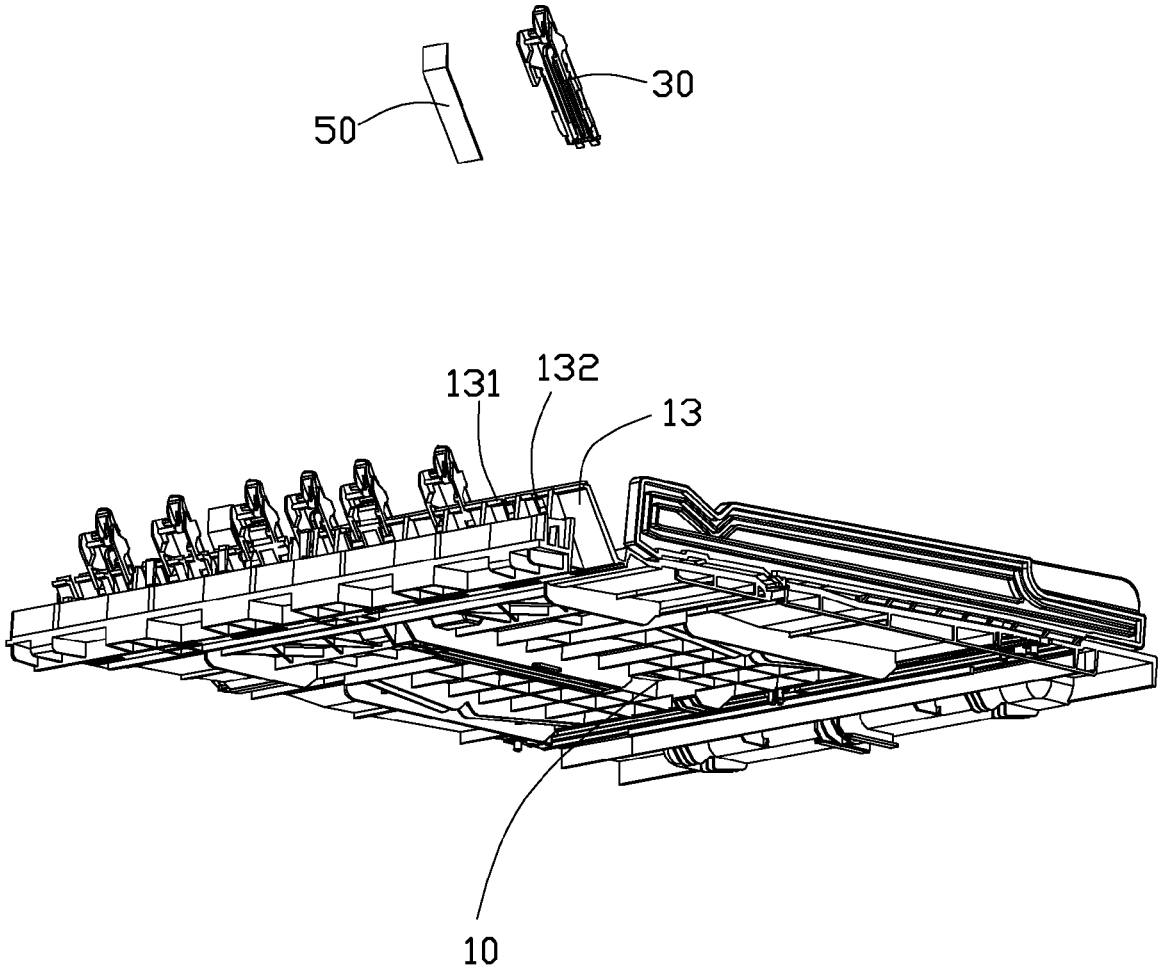
FIG. 2 is similar to FIG. 1, but viewed from another aspect.
Figure 3:
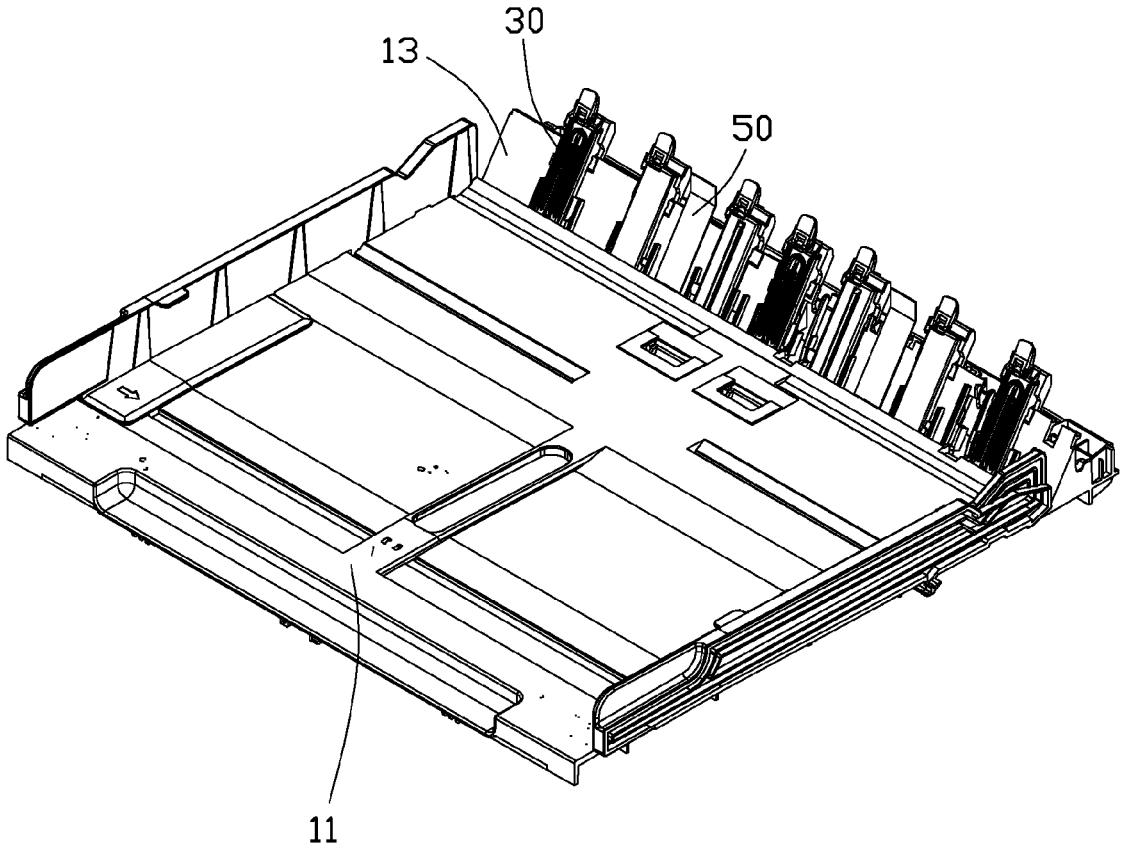
FIG. 3 is an assembled view of the paper tray of FIG. 1.
Figure 4:
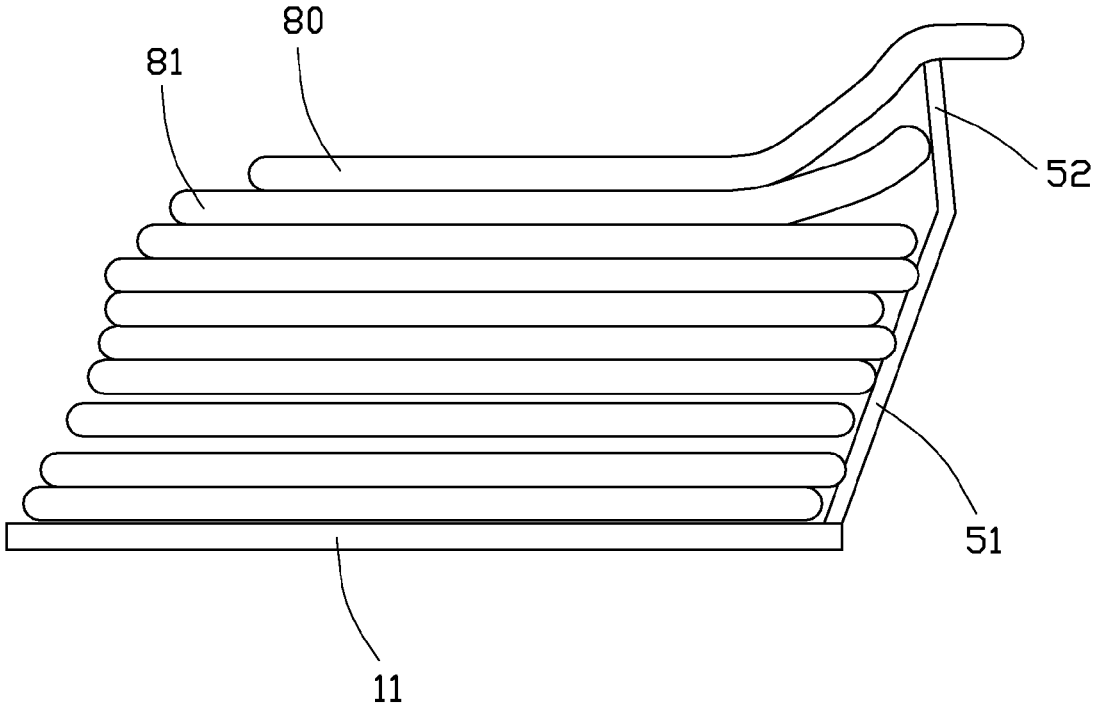
FIG. 4 is a sketch view of the paper tray of FIG. 1.

Referring to FIGS. 1 and 2, a paper tray 10 of a printer in accordance with an embodiment includes a bottom plate 11, two side plates 12, a rear plate 13. The two side plates 12 are connected to the left and the right edges of the bottom plate 11. The rear plate 13 is obliquely connected to a rear edge of the bottom plate 11. A plurality of papers can be placed on the bottom plate 11. The two side plates 12 and the rear plate 13 together restrict the plurality of papers on the bottom plate 11. For feeding paper in a printer (not shown), one piece of paper located on the bottom plate 11 is moved across the rear plate 13 to be fed in the printer.

The rear plate 13 includes a plurality of parallel restricting ribs 14. A plurality of guiding pieces 30 and bent pieces 50 can be secured between the plurality of parallel restricting ribs 14. A plurality of slits 15 is defined between a connection portion of the rear plate 13 and the bottom plate 11. A top edge of the rear plate 13 extends rearward to form an extending portion 131. A rear portion of the extending portion 131 defines a plurality of cutouts 132.

Each guiding piece 30 includes a main body 31. A bottom end of the main body 31 forms a pair of insert slices 32. A length of the main body 31 is greater than a width of the rear plate 13. A top end of the main body 31 extends rearward and downward to form a pair of locks 35. A distal end of each lock 35 forms a hook 36.

Each bent piece 50 includes a first piece 51 and a second piece 52. An obtuse angle is defined between the first piece 51 and the second piece 52. A length of the first piece 51 is greater than the width of the rear plate 13. A length of the second piece 52 is smaller than the length of the first piece 51.

Referring to FIGS. 1 to 4, in assembly, the guiding piece 30 is located between two adjacent restricting ribs 14. The main body 31 of the guiding piece 30 is placed on the rear plate 13. The lock 35 of the guiding piece 30 is received in corresponding cutout 132 of the rear plate 13. Then, the guiding piece 30 slides on the rear plate 13 to insert the pair of insert slices 32 into corresponding slits 15. Simultaneously, the hook 36 is engaged on the rear plate 13 to secure the guiding piece 30 on the rear plate 13.

The bent piece 50 is located between another two adjacent restricting ribs 14 of the rear plate 13. The first piece 51 of the bent piece 50 is placed on the rear plate 13. A bottom end of the first piece 51 is inserted in corresponding slit 15 to secure the bent piece 50 on the rear plate 13.

In use, when a first paper 80, which is located on a topmost portion of the plurality of paper, is moved across the rear plate 13. A second paper 81, which is located below the first paper 80, is brought to move together with the first paper 80. Because the first paper 80 is driven by a large force, a head portion of the first paper 80 can slide along the guiding pieces 30 and the first pieces 51 and further slide over the second pieces 52 to be fed in the printer. However, the second paper 81 is brought by a small force. The small force cannot move the second paper 81 over the second pieces 52. The second pieces 52 block the second paper 81 from being fed in the printer.

In the paper tray 10, the second pieces 52 of the bent pieces 50 allow the first paper 80 sliding there over, and block the second paper 81 sliding there over. Therefore, only one piece of paper is fed into the printer at one time.

It is to be understood, however, that even though numerous characteristics and advantages of the embodiments have been set forth in the foregoing description, together with details of the structure and functions of the embodiments, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A paper tray for a printer, comprising:

a bottom plate, the bottom plate being configured to received stacks of paper; and a rear plate connected to a rear edge of the bottom plate, a plurality of bent pieces secured on the rear plate, each of the plurality of bent pieces comprising a first piece and a second piece, the first piece being placed on the rear plate, and an obtuse angle being defined between the first piece and the second piece, the second pieces being bent towards to the rear plate;

wherein the second pieces of the plurality of bent pieces are configured to allow a topmost piece of paper of the stacks to slide over, and to block a second topmost piece of paper of the stacks from sliding over the second pieces of the plurality of bent pieces;

wherein a plurality of guiding pieces are secured on the rear plate, each of the plurality of guiding pieces comprises a main body, and the main body is placed on the rear plate; a top end of the main body extends rearward and downward to form a pair of locks, a distal end of each lock comprises a hook; a top edge of the rear plate extends rearward to form an extending portion, a rear portion of the extending portion defines a plurality of cutouts; and the locks of the plurality of guiding pieces are received in the cutouts, and the hooks of the plurality of guiding pieces are engaged on the rear plate.

2. The paper tray of claim 1, wherein the rear plate is obliquely connected to the rear edge of the bottom plate.

3. The paper tray of claim 2, further comprising two side plates connected to opposite edges of the bottom plate, wherein the two side plates and the rear plate together restrict the plurality of papers on the bottom plate.

4. The paper tray of claim 1, wherein the rear plate comprises a plurality of parallel restricting ribs, and each of the plurality of bent pieces is restricted between two adjacent restricting ribs of the plurality of parallel restricting ribs.

5. The paper tray of claim 4, wherein a plurality of slits is defined in a connection portion of the rear plate and the bottom plate, and bottom ends of the first pieces of the plurality of bent pieces are inserted in the plurality of slits.

6. The paper tray of claim 1, wherein a length of the first piece is greater than a width of the rear plate, and a length of the second piece is smaller than the length of the first piece.

7. The paper tray of claim 1, wherein a bottom end of the main body forms a pair of insert slices, a plurality of slits is defined in a connection portion of the rear plate and the bottom plate, and the insert slices of the plurality of guiding pieces are inserted in the plurality of slits.

8. A paper tray for a printer, comprising:

a bottom plate configured to support stacks of paper thereon;

a rear plate connected to the bottom plate, sheets of the stacks configured to slide over the rear plate to be fed into the printer; and a bent piece secured on the rear plate, the bent piece comprising a first piece and a second piece, the first piece being located on the rear plate, an obtuse angle defined between the second piece and the rear plate, the second piece being bent towards to the rear plate, and the second piece configured to allow a topmost paper of the plurality of papers to slide over, and to block other papers of the plurality of papers from sliding over the second piece;

wherein a guiding piece is secured on the rear plate, the guiding piece comprises a main body, and the main body is placed on the rear plate; a top end of the main body extends rearward and downward to form a pair of locks, a distal end of each lock comprises a hook; a top edge of the rear plate extends rearward to form an extending portion, a rear portion of the extending portion defines two cutouts; and the pair of locks of the guiding piece are received in the two cutouts, and the hooks of the guiding piece are engaged on the rear plate.

9. The paper tray of claim 8, wherein the rear plate is obliquely connected to the rear edge of the bottom plate.

10. The paper tray of claim 9, further comprising two side plates connected to opposite edges of the bottom plate, wherein the two side plates and the rear plate together restrict the plurality of papers on the bottom plate.

11. The paper tray of claim 8, wherein the rear plate comprises two parallel restricting ribs; the bent piece further comprises a first piece, and the first piece is placed on the rear plate and restricted between the two restricting ribs.

12. The paper tray of claim 11, wherein a slit is defined in a connection portion of the rear plate and the bottom plate, and a bottom end of the first piece of the bent piece is inserted in the slit.

13. The paper tray of claim 11, wherein a length of the first piece is greater than a width of the rear plate, and a length of the second piece is smaller than the length of the first piece.

14. The paper tray of claim 8, wherein a bottom end of the main body forms a pair of insert slices, two slits are defined in a connection portion of the rear plate and the bottom plate, and the pair of insert slices are inserted in the two slits.

15. A paper tray for a printer, comprising:

a bottom plate configured to support stacks of paper thereon;

a rear plate connected to the bottom plate, sheets of the stacks of paper configured to slide over the rear plate to be fed into the printer; and a bent piece secured on the rear plate, the bent piece comprising a first piece and a second piece, the first piece being located on the rear plate, an obtuse angle being defined between the second piece and the rear plate, and the second piece being configured to allow a topmost sheet of the stacks to slide over the second piece, and to block a remaining sheets of the stacks from sliding;

wherein a guiding piece is secured on the rear plate, the guiding piece comprises a main body, and the main body is placed on the rear plate; a top end of the main body extends rearward and downward to form a pair of locks, a distal end of each of the pair of locks comprises a hook; a top edge of the rear plate extends rearward to form an extending portion, a rear portion of the extending portion defines two cutouts; and each of the pair of locks is received in each of the two cutouts, and the hook is engaged on the rear plate.

* * * * *